United States Patent [19]

Allen

[11] Patent Number: 4,544,194

[45] Date of Patent: Oct. 1, 1985

[54] PLURAL BOTTLE CARRIER

[75] Inventor: Frederick C. Allen, Waterville, Ohio

[73] Assignee: Owens-Illinois, Inc., Toledo, Ohio

[21] Appl. No.: 619,107

[22] Filed: Jun. 11, 1984

Related U.S. Application Data

[63] Continuation of Ser. No. 383,058, May 28, 1982, abandoned.

[51] Int. Cl.[4] ..... B65D 71/04

[52] U.S. Cl. ..... 294/87.2; 206/150

[58] Field of Search ..... 294/87.2, 87.28; 206/141, 143, 150–153, 158, 161, 199, 427

[56] References Cited

U.S. PATENT DOCUMENTS

| | | | |
|---|---|---|---|
| 2,997,169 | 8/1961 | Poupitch | 294/87.2 X |
| 3,232,422 | 2/1966 | Whyte | 294/87.2 X |
| 3,721,337 | 3/1973 | Braun et al. | 294/87.2 X |
| 3,930,578 | 1/1976 | Stein | 294/87.2 X |
| 3,938,656 | 2/1976 | Owen | 206/150 |
| 3,966,044 | 6/1976 | Cunningham | 294/87.2 X |
| 4,231,605 | 11/1980 | Newman | 294/87.2 |
| 4,249,766 | 2/1981 | Erickson | 294/87.2 |

*Primary Examiner*—Johnny D. Cherry

*Attorney, Agent, or Firm*—Philip M. Rice; John R. Nelson

[57] ABSTRACT

A carrier configuration for two or more bottles such as beverage bottles includes an inner member having regions which receive each of the bottle necks and an outer member which extends about the grouping of bottles at their midsections. The inner member is sized to nest within the outer member and they may be punched simultaneously from a flat sheet of material such as polyethylene. Preferably, the adjacent inner edge of the outer member and the outer edge of the inner member are partially connected and scored by the punching operations such that they may be readily separated from one another as they are installed in the positions above described on a grouping of containers.

4 Claims, 7 Drawing Figures

PLURAL BOTTLE CARRIER

This is a continuation of application Ser. No. 383,058 filed May 28, 1982, now abandoned.

BACKGROUND OF THE INVENTION

The invention relates generally to bottle carriers and more specifically to a two component, carrier which grips a grouping of bottles about their necks and midsections.

The consumer beverage container market is innovative, fast moving and competitive. Innovative because new materials and processes permit new structural configurations and ornamental designs; fast moving because not only the just-described influences but also the changeability of consumer preferences and trends places a premium on a contemporary package and competitive inasmuch as the high production volume of such containers encourages and rewards low per unit cost. Intrinsically tied to the consumer container market and exhibiting many of the same market characteristics as containers are container packaging products. This is not surprising since as containers evolve so must their packages.

Numerous plural container packages are described in the prior art. For example, U.S. Pat. No. 3,186,544 teaches a carrier having a plurality of cinctures or loops which extend about a like plurality of bottles having an outwardly directed circumferential bead about their midsections. The carrier also includes a pair of lifting handles. This device would appear to function only with bottles which have been specially formed to include the circumferential bead. U.S. Pat. No. 3,476,237 teaches a package construction similar to what has become known as blister packing. In addition to an outer shrink wrap, however, the carrier includes a plurality of clips or plastic preforms which maintain the beverage containers in adjacent parallel alignment. Aside from routine difficulties of removing the contents from a blister pack, this configuration appears to incorporate a significant quantity of material and thus its attractiveness from an economic standpoint is reduced.

Specially shaped containers often engender specially shaped carriers and U.S. Pat. No. 3,702,203 discloses just such a carrier. Here, a pair of high-waisted containers are engaged by a single strap having a finger loop disposed at each end. The strap is disposed about the waists of the containers in a figure-eight pattern and the loops are juxtaposed intermediate the containers to form a unitary gripping means. A somewhat related device is disclosed in U.S. Pat. No. 3,709,544. Here, a tee shaped or alternate right angle strap is disclosed which is intended for use with containers having peripheral lips such as coffee cans or paint cans. With either strap configuration, a portion of a strap extends about the periphery of the container, directly below the bead and is secured to itself. The remaining portion of the strap forms a handle which stands above the container to facilitate manual engagement. Since no provision appears to have been made in the strap for adjusting its length, it therefore appears that the strap could not be utilized with but one container size inasmuch as the strap must fit snugly about the container if it is to be precluded from slipping past the relatively small lip.

SUMMARY OF THE INVENTION

The instant invention comprehends a two part carrier assembly for two or more containers such as beverage bottles. The carrier comprises a first or inner member having regions which receive the necks of each of the containers in a grouping and a second or outer member which extends about the grouping of containers at about their vertical midsections. The inner and outer member may be punched simultaneously from a flat sheet of material such as polyethylene. The inner member is sized to nest within the outer member, having a common edge portions which are scored or perforated therealong. Preferably such scoring or perforation is accomplished by the punching die.

Assembly of the inner and outer members of the carrier on a grouping of bottles is straight forward. In a single operation, the inner member is forced down over the closures of the bottles and seats about their necks. Additional force and travel is imparted to the outer member such that it separates from the inner member as it is moved further down about the grouping of bottles and is positioned at approximately their midsections. The members are sized such that they snugly grip the bottles and maintain them in intimate juxtaposition. Two embodiments of the invention are herein disclosed; one embodiment with certain variations which is intended for use with two beverage bottles and a second embodiment intended for use with six beverage bottles but which may readily expanded or reduced to package more or fewer bottles.

Thus it is an object of the instant invention to provide a bottle carrier which may be fabricated in a single component and which when installed separates into two pieces.

It is a further object of the instant invention to provide a beverage container carrier which may be utilized with two, four, six, eight or more beverage bottles.

It is a still further object of the instant invention to provide a carrier for beverage bottles which is simple, readily installed and inexpensive.

It is a still further object of the instant invention to provide a two-part, multi container carrier from which the bottles may be readily and easily removed.

Further objects and advantages of the instant invention will become apparent by reference to the following description of the preferred embodiments and appended drawings.

DESCRIPTION OF THE PREFERRED EMBODIMENTS

Figure 1:
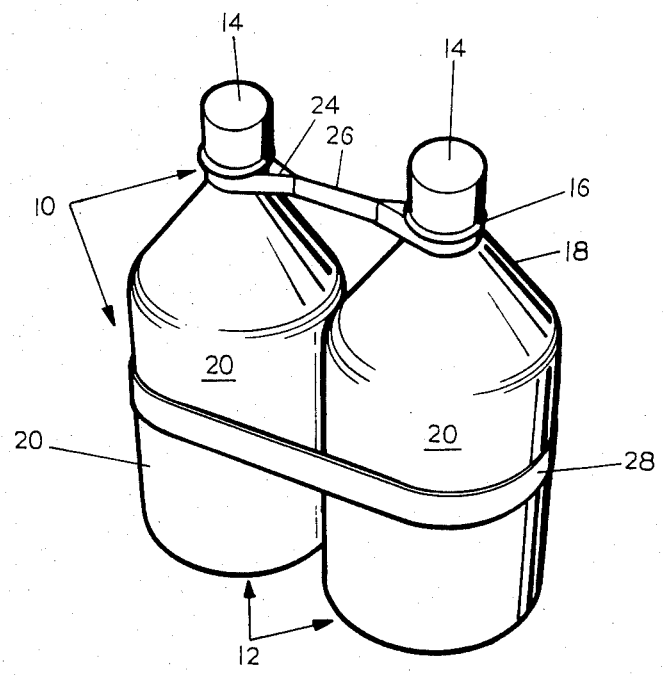
FIG. 1 is a perspective view of a first embodiment of a two bottle carrier in place on a pair of beverage containers.

Referring now to FIG. 1, a two bottle carrier assembly is illustrated and generally designated by the reference numeral 10. The two bottle carrier assembly 10 is shown in place on a pair of juxtaposed beverage containers or bottles 12. The bottles 12 each include a finish which is obscured by a closure 14, a peripheral bead 16 which is disposed directly below the finish and the closure 14, a neck region 18 disposed directly below the bead 16 and an enlarged diameter body 20. The bead 16 may take the form of a thin, radially extending ledge such as that associated with plastic, blow molded containers, a smoothly rounded projection such as that utilized on containers intended for use with crown closures or some other generally similar form. It should be understood that since the bead forms no part of the instant invention and further that the instant invention will function equally well with a broad range of bead sizes and configurations including substantially none at all, this structure is not of major significance. It should also be understood that the bottles 12 are illustrated for purposes of explanation and example and should therefore neither be considered to be the sole bottle configuration with which the instant invention will cooperate nor be construed to limit the instant disclosure and invention in any manner. Extending between and about the necks 18 of the bottles 12 is a first band 24. The first band 24 is in tension and seats against the necks 18 of the bottles 12 generally below the beads 16 and/or the closures 14 and retains the upper portions of the bottles 12 together. As the above disussion regarding the size and shape of the beads 16 should make apparent, the primary bottle securement method is the tension provided by the stretched first band 24 and, to a lesser entent, the purchase on the bottles 12 provided by engagement of the first band 24 against the beads 16. The central portion 26 of the first band 24 also functions as an engageable member whereby the bottles 12 may be readily lifted and transported by the fingers of a hand. The carrier assembly 10 also includes a second band 28 which extends about the enlarged diameter region or body 20 of the bottles 12 at approximately their midsections. The second band 28 is also in tension and holds the bottles 12 and particularly the bodies 20 in intimate contact with one another. Cooperatively, the first band 24 and the second band 28 maintain the bottles 12 in substantially parallel, aligned contact and provide a package having good integrity and pleasing appearance. Furthermore, the package is simple, easy to transport and readily removed from either or both of the two bottles 12.

Figure 2:
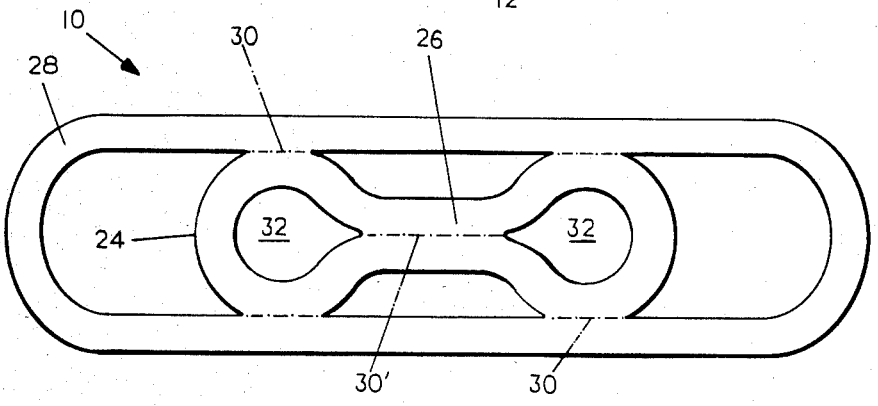
FIG. 2 is a plan view of a first embodiment of a two bottle carrier according to the instant invention.

Referring now to FIG. 2, the post-production and pre-assembly state of the first embodiment of the carrier assembly 10 is illustrated. The first band 24 defines a dog bone or closed figure-eight pattern disposed within and having outer edges in common with the inner edges of the second band 28 which defines an elongate oval. The regions of common edge, that is, the coinciding portions of the outer edge of the first band 24 and the inner edge of the second band 28 are defined by perforated or scored lines 30 to facilitate separation of element of the assembly 10 as it is installed upon a pair of bottles 12 as illustrated in FIG. 1. The center line 30' is also scored to facilitate folding and sealing steps which will be more fully described below. The first band 24 also defines a pair of apertures 32 which are sized to snugly fit about the neck 18 of a respective one of the bottles 12, as illustrated in FIG. 1. The two bottle carrier assembly 10 is preferably punched from a flat sheet of material by conventional techniques and, as noted above, the perforated edges 30 are preferably formed during the same manufacturing step.

Figure 3:
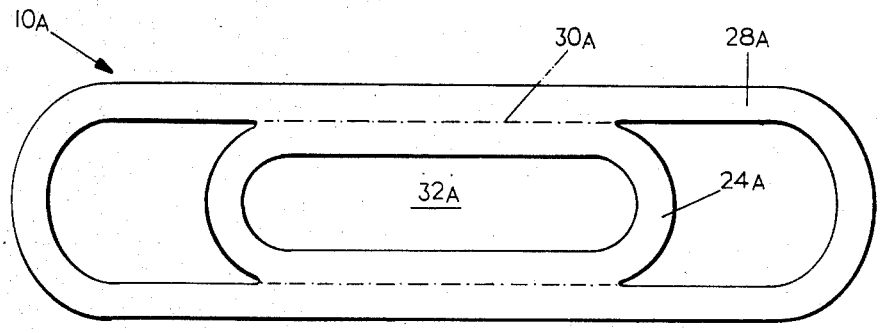
FIG. 3 is a plan view of a second embodiment of a two bottle carrier according to the instant invention.

Referring now to FIG. 3, a second, alternate embodiment of a two bottle carrier assembly 10A is illustrated. The elements of the two bottle carrier 10A are similar to the first embodiment of the carrier assembly 10 and include a first band 24A and a second band 28A. The first band 24A is an elongate oval which is nested within the second band 28A and the bands 24A and 28A have common perforated or scored edges 30A along the central portion of the inner edge of the second band 28A and the outer edge of the first band 24A. The first band 24A defines a single oval aperture 32A which receives the necks 18 of the bottle 12 in a manner analogous to the pair of apertures 32 in the first embodiment of the two bottle carrier assembly 10. The second band 28A defines an elongate oval. Here again, the second embodiment of the two bottle carrier assembly 10A is preferably punched from a sheet of plastic material and the first band 24A and the second band 28A are sized to fit tightly about the necks 18 and the bodies 20 of the bottles 12, respectively, and to hold them together.

Figure 4:
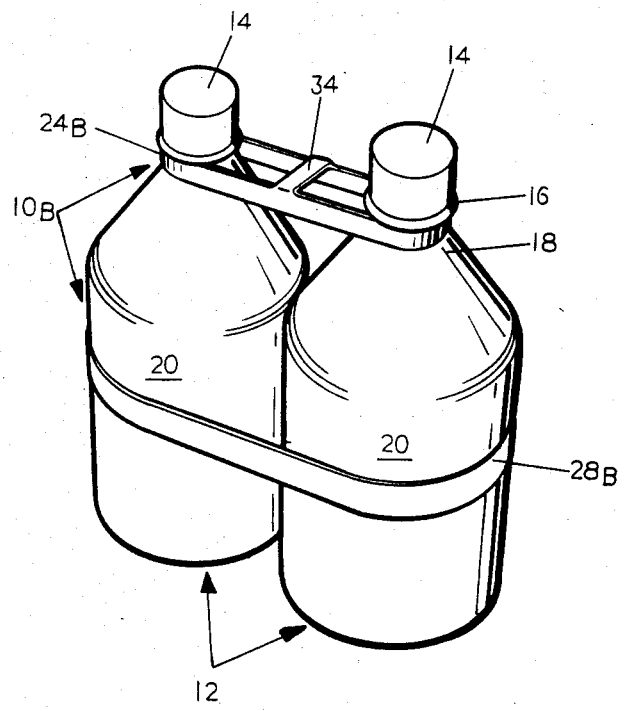
FIG. 4 is a perspective view of a third embodiment of a two bottle carrier according to the instant invention in place upon a pair of beverage containers.
Figure 5:
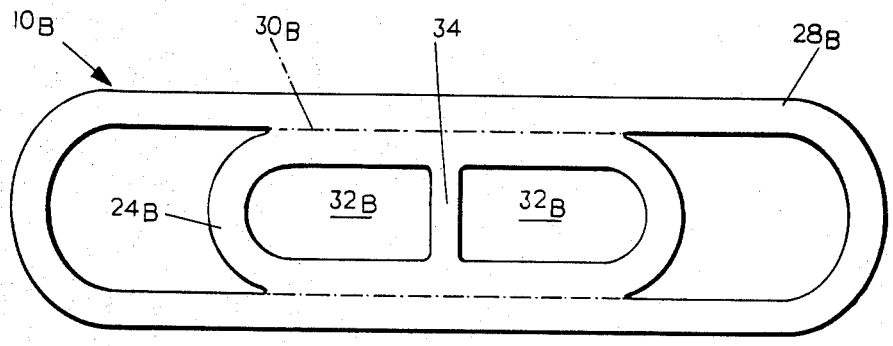
FIG. 5 is a plan view of a third embodiment of a two bottle carrier according to the instant invention.

Turning now to FIGS. 4 and 5, a third, alternate embodiment of a two bottle carrier assembly 10B is illustrated. The bottles 12 and their components, the finishes and closures 14, the beads 16, the necks 18 and the bodies 20 are also identical to those illustrated and described previously. Again, however, the broad application of the instant invention will be readily apparent and should not be construed to be limited by its illustration upon a single or particular bottle design. In the third embodiment of the two bottle carrier assembly 10B, the first band 28B seats about the necks 18 of the containers 12 and includes a perpendicular rib or web 34 which spans the central region of the first band 24B and defines a pair of apertures 32B which receive the bottle necks 18. Here, too, the first band 24B defines an oval nested within the larger, oval second band 28B and has common edges 30B which are defined by scoring or perforations along the outer edge of the first band 24B and the corresponding inner edge of the second band 28B. The web 34 provides a readily engageable handle which further improves the overall convenience and transport ease of the package.

Figure 6:
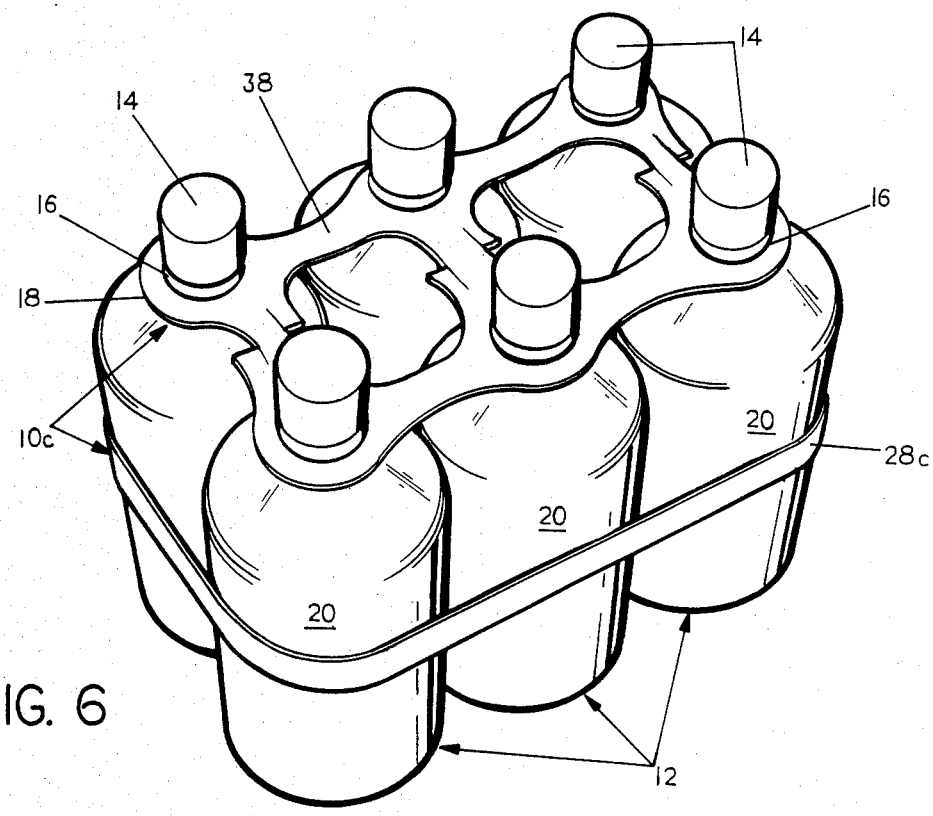
FIG. 6 is a perspective view of an embodiment of a six bottle carrier according to the instant invention in place upon six beverage bottles and FIG. 7 is a plan view of an embodiment of a six bottle carrier according to the instant invention.
Figure 7:
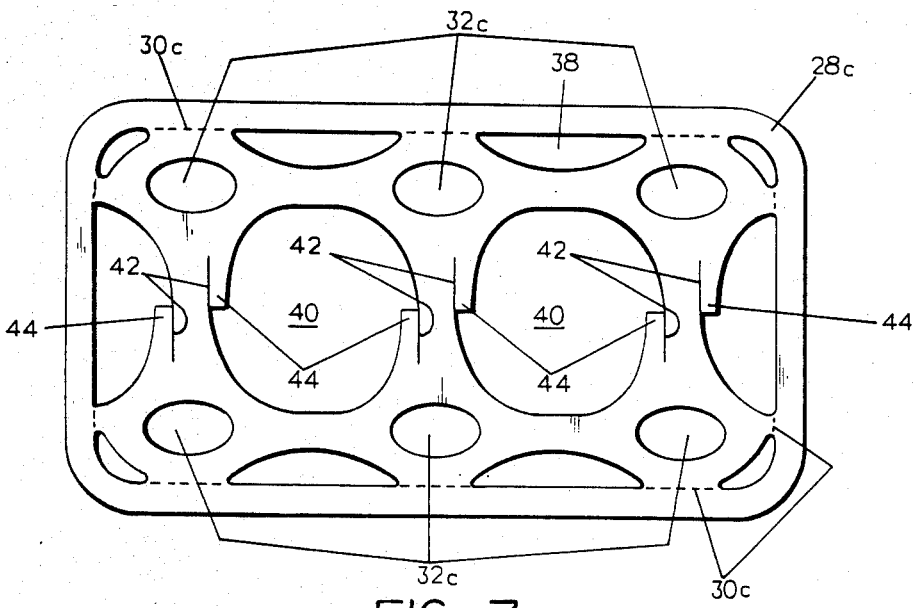

Referring now to FIGS. 6 and 7, an embodiment of a plural bottle carrier assembly 10C according to the instant invention, intended for use with six bottles 12, is illustrated. The six bottle carrier assembly 10C includes a web 38 which is structurally analogous to the bands 24 through 24B described previously with regard to the other embodiments and a band 28C which is in all respects identical and analogous to the bands 28 through 28B described with regard to the other embodiments. The web 38 defines a plurality of apertures 32C which snugly receive the necks 18 of the bottles 12. The web 38 also defines a pair of larger apertures 40 which are disposed generally in the regions between the apertures 32C. A portion of the web 38 adjacent the apertures 40 includes a scored or perforated line 42 and defines a tab 44, the purpose of which will be described more fully below. The web 38, in a manner analogous to the other embodiments, is nested within the band 28C and their common edges, i.e., the inner edge of the band 28C and outer edge of the web 38 are defined by perforated or scored lines 30C. It should be readily apparent from the drawings that the web 38 and the band 28C may be extended as required to encompass plural pairs of the containers 12 up to any readily transportable limit. Conversely, the web 38 and the band 28C may be reduced in length to band together as few as two of the bottles 12.

With reference now generally to all of the drawing figures, assembly of the various plural bottle carrier assemblies 10 through 10C will be described. The assembly operations are similar in that all the assemblies 10 through 10C are initially fabricated from flat plastic material in the forms illustrated in FIGS. 2, 3, 5 and 7 by conventional sheet punching and scoring techniques. Subsequent to the punching and scoring or perforating operation, each of the assemblies 10 to 10C comprise a unitary structure. In this unitary configuration, the assemblies 10 through 10C are positioned over a juxtaposed pair or juxtaposed multiple pairs of containers 12 and the apertures 32 through 32C are aligned with the closures 14 and moved downwardly over the closures 14 and the beads 16 such that the first bands 26 through 26B or the web 38 is disposed about the necks 18 of the bottles 12. When the inner bands 26 through 26B or the apertures 32C of the web 38 are fully seated about the necks 18 of the bottles 12, they remain substantially fixed in this position. The outer bands 28 through 28C are moved further down the bottles 12 and, by virtue of this downward movement, the perforations 30 through 30C which constitute weakened lines or line portions between the first bands 26 through 26B or the web 38 shear or release and the bands 28 through 28C may then be moved further down to approximately the midsection of the bottles 12.

With regard to the first and second embodiments of the two bottle carrier assemblies 10 and 10A, an additional step may be included. Such additional step comprehends the sealing or securement of the two sides of the first band 24 or 24A to one another in a region intermediate the necks 18 of the two bottles 12. The first band 24 of the first embodiment of the two bottle carrier assembly 10 may conveniently be folded along the perforated center line 30' before this step. This step may be accomplished by conventional heat sealing or similar techniques and further improves the security and integrity of the package.

Referring now briefly to FIG. 7, it will readily be appreciated that the two bottle carrier assemblies 10 through 10B do not create significant problems with regard to removal of one of the bottles 12 from the carrier assembly 10 through 10B due to the number of bottles involved. However, with the plural bottle carrier assembly 10C, it is preferable to readily permit the web 38 to remain with the unutilized bottles 12 to maintain them in a neat and orderly fashion. For this reason, as well as obvious other reasons, it is desirable to provide a ready means for individually releasing the bottles 12 from the web 38. This easy release feature is provided by the scored or perforated lines 42 and the tabs 44. When it is desired to remove one of the bottles 12, the tab 44 most adjacent and aligned with the aperture 32C within which the neck 18 of the desired bottle 12 resides is lifted and pulled away from the web 38. The scored or perforated line 42 provides a shear or tear line generation site which propagates, when the tab 44 is lifted, toward the adjacent, aligned aperture 32C. By interrupting the web 38 adjacent the aperture 32C, the diameter of the aperture 32C is readily enlarged and the neck 18 and particularly the enlarged diameter bead 16 of the bottle 12 may be readily removed from the web 38.

With regard to all of the embodiments of the plural bottle carrier assemblies 10 through 10C, they are preferably fabricated of low density polyethylene or similar material which exhibits good elasticity. That is, the material must be capable of being stretched over the beads 16 of the bottles 12 as well as over the bodies 20 of the bottles 12 and then rapidly recover from such stretched condition to grip the bottles tightly such that the bands 24 through 24B, and 28 through 28C as well as the web 38 (and bottles 12) remain in their proper locations. Preferably, the polyethylene is approximately 15 to 25 mils thick. Other materials exhibiting the appropriate elasticity but increased strength such as linear low density resins may be utilized in reduced thicknesses.

The foregoing disclosure is the best mode devised by the inventor for practicing this invention. It is apparent, however, that devices incorporating modifications and variations will be obvious to one skilled in the art of container carriers. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. A plural container carrier for securing together a pair of identical containers, each said container having an open neck finish portion, an outstanding bead portion disposed below said finish portion, an angled shoulder portion disposed below said bead portion and an elongate, hollow, enlarged diameter closed bottom, main body portion, said main body portion being in communication with said open neck finish portion, said carrier comprising:

a body of elastic, thermoplastic material initially formed in a single sheet and including a first, elongated inner portion suited to engage each of the containers and upon engagement be disposed under said outstanding bead portion of said containers and a second, elongated, outer band portion surrounding said first portion and initially connected thereto along a pair of perforated score lines, said first portion of said carrier having a pair of container receiving apertures adapted to register and be stretched about the neck finish portion of said pair of containers, with said container bead portions of said containers protruding through said container receiving apertures wherein said first portion of said carrier has a central, generally rectangular web portion connecting the container receiving apertures which are defined by a pair of closed, curvilinear container engaging loop portions, and said web portion is divided into two sides by a perforated line extending therealong between said pair of closed curvilinear container engaging loop portions whereby said web is easily folded along said perforated line;

such that as the carrier is lowered onto the pair of containers and forced downwardly to engage the containers, the loop portions engage the containers, are forced over the bead portions and said web portion becomes folded so that the first inner portion engages the containers under the bead portion and the second outer band portion is severed from the first inner portion along the perforated lines therebetween and the second outer band portion is stretched about the main body portion of the containers.

2. The carrier as defined in claim 1 wherein the two sides of said web portion that is easily folded along said perforated line are sealed together prior to assembly of the carrier onto the containers, to thereby form a folded handle.

3. A plural container carrier for securing together a pair of identical containers, each said container having an open neck finish portion, an outstanding bead portion disposed below said finish portion, an angled shoulder portion disposed below said bead portion and an elongate, hollow, enlarged diameter closed bottom, main body portion said main body portion being in communication with said open neck finish portion, said carrier comprising:

a body of elastic, thermoplastic material initially formed in a single sheet and including a first inner portion suited to engage each of the containers and upon engagement be disposed under said outstanding bead portions of said containers and a second outer band portion surrounding said first portion and initially connected thereto along perforated score lines, said first inner portion of said carrier having a container receiving aperture adapted to register and be stretched about the neck finish portion of said pair of containers, with said container bead portions of said containers protruding through said aperture wherein said first portion of said carrier has a pair of curvilinear end portions adapted to engage said containers, said end portions being joined by a pair of side portions which in turn are connected by said perforated score lines to the outer band portion, such that as the carrier is lowered onto the container array and forced downwardly to engage the containers, the second outer band portion of the carrier is severed from the first portion along the perforated score lines and the second outer portion is stretched about the main body portion of the containers.

4. The carrier defined in claim 3 wherein an elastic thermoplastic web portion extends between and joins said side portions at their midpoints.

* * * * *